US008101008B2

(12) United States Patent
Zhou

(10) Patent No.: US 8,101,008 B2
(45) Date of Patent: Jan. 24, 2012

(54) ANODE REFINEMENT METHOD FOR HIGH-SULFUR CONTENT COARSE COPPER

(75) Inventor: Songlin Zhou, Shandong (CN)

(73) Assignee: Xiangguang Copper Co., Ltd., Shifo Town, Liaocheng, Shangdong Province (CN)

( * ) Notice: Subject to any disclaimer, the term of this patent is extended or adjusted under 35 U.S.C. 154(b) by 563 days.

(21) Appl. No.: 12/340,649

(22) Filed: Dec. 20, 2008

(65) Prior Publication Data

US 2010/0154595 A1 Jun. 24, 2010

(51) Int. Cl.
*C22B 15/14* (2006.01)
*C22B 9/05* (2006.01)

(52) U.S. Cl. ..... 75/648; 75/643; 75/645

(58) Field of Classification Search ..... 75/638, 75/643, 645, 648
See application file for complete search history.

(56) References Cited

U.S. PATENT DOCUMENTS 6,210,463 B1 * 4/2001 George et al. ..... 75/640
6,403,043 B1 * 6/2002 Utigard et al. ..... 423/47

* cited by examiner

*Primary Examiner* — George Wyszomierski
*Assistant Examiner* — Mark L Shevin
(74) *Attorney, Agent, or Firm* — Global IP Services; Tian Hua Gu

(57) ABSTRACT

An anode refinement method for high-sulfur content coarse copper: while high-sulfur coarse copper liquid from a flash converting furnace flows to the anode furnace through a chute, inert gas is continuously added, to stir the copper liquid and improve discharging of the $SO_2$ produced from reaction of the sulfur with oxygen in the liquid and the oxygen absorbed from the atmosphere, so as to remove more than 90% sulfur in the coarse copper liquid. After the coarse copper liquid is fully led to the anode furnace, operations of low-oxidization and low-reduction, non-oxidization and low-reduction or cancel of reduction-oxidization are conducted according to the sulfur content in the copper liquid. The method can resolve the shortages in the fire-refining process, save working time, notably improve production efficiency and capacity, save energy, and settle the pollution problem of black smoke in the atmosphere.

11 Claims, 1 Drawing Sheet

ANODE REFINEMENT METHOD FOR HIGH-SULFUR CONTENT COARSE COPPER

FIELD OF THE INVENTION

The invention is involved in copper metallurgy, or definitely, it's a refinement technique for high-sulfur content coarse copper.

BACKGROUND OF THE INVENTION

"Double-flash" copper-refining technique is: copper concentrate→flash melting→matte→flash converting→coarse copper→positive-pole refinement→anode copper→electrolysis→high-purity cathode copper. As the most advanced technique in copper refinement at present, it represents the development direction in the future, but sulfur content in the coarse copper produced in flash converting process is higher than that in traditional PS furnace converting, to see sulfur content in flash converting 0.1-5%, while that in PS furnace converting 0.03-0.08%. Now, traditional method of deep oxidization and reduction is still adopted for the fire-refining of these high-sulfur content coarse copper, i.e. air or oxygen is first led in to carry out deep oxidization to reduce sulfur content in copper liquid to less than 0.003%, then use reducers, such as natural gas, liquefied petroleum, heavy oil, diesel oil or pulverized coal to conduct deep reduction to eliminate surplus oxygen. This method, featured with first deep oxidization and then deep reduction, will not only consume large amounts of natural gas and other nonrenewable resources, wasting energy sources, but also prolong refining time, reduce refining efficiency, and the working condition is bad, environment pollution severe.

SUMMARY OF THE INVENTION

This invention puts forward an anode refinement method for high-sulfur content coarse copper, which can solve the problems in the processes above, effectively save working time, improve production efficiency and capacity, conserve energy, and eliminate air pollution of black smoke on atmospheric environment.

The invention is realized through following technical scheme: while high-sulfur coarse copper liquid from flash converting furnace flows to the anode furnace through a chute, inert gas is continuously added, to make the copper liquid boiling, and improve discharging of the $SO_2$ produced from reaction of the sulfur with oxygen in the liquid and the oxygen absorbed from atmosphere, so as to remove more than 90% sulfur in the coarse copper liquid. After the coarse copper liquid is fully led to anode furnace, operations of low-oxidization and low-reduction, non-oxidization and low-reduction or cancel of reduction-oxidization is conducted according to sulfur content in the copper liquid, i.e. low-oxidization and low-reduction operation is adopted if the sulfur content of the copper liquid is more than 0.05%, that to say, to conduct low-reduction while the sulfur is reduced to 0.05% through low-oxidization; if the sulfur content is less than 0.05%, non-oxidization and low-reduction is adopted; if the sulfur content is less than 0.003% and oxygen content less than 0.2%, reduction-oxidization operation is cancelled. The value of sulfur content to determine choice of operation can also be 0.07%, 0.08% or 0.1%, but the working time will be the shortest and efficiency highest only when it is 0.05%. Coarse copper liquid flows to the anode furnace with flow rate of 50-100 tons per hour; flow rate of inert gas 50~2000 $Nm^3/h$, pressure 0.4~0.8 MPa, temperature 25~300° C.; air flow rate for low-oxidization 100~1000 $Nm^3/h$, pressure 0.3~0.8 MPa; gas flow rate for low-reduction 100~1000 $Nm^3/h$, pressure 0.3~0.8 MPa, pressure in furnace ±200 Pa. The inert gas as stated is argon or nitrogen; the reduction gases as stated are natural gas, liquefied petroleum gas or city gas, etc; the inert gas is blown to anode furnace through ventilation installation at the bottom of the furnace, and the ventilation installation, as stated, are the ventilation bricks at the bottom of the furnace. It's applicable for refinement of high-sulfur content coarse copper, with sulfur content in coarse copper 0.1%~5%, from all kinds of metallurgic furnaces.

Principles of the invention: in traditional anode refinement process for high-sulfur content coarse copper, deep oxidization and reduction is adopted, i.e. after the high-sulfur content coarse copper produced in flash converting is led to anode furnace, blow air or oxygen from air-inlet of anode furnace to conduct deep oxidization and reduce sulfur content of the copper liquid to less than 0.003%, then carry out deep reduction with reduction gas (if natural gas, the flow rate 3500 $Nm^3/h$). Industrial practice indicates that, because Cu is much more than S in coarse copper liquid, the efficiency of deep oxidization is not high, especially for the process of reducing sulfur from 0.05% to 0.003%, the oxidization efficiency is very low and oxidization time extremely long. For an anode furnace with capacity of 500 tons, oxidization time of every furnace of copper will be as long as 10 hours, and while sulfur content is reduced to less than 0.003% in deep oxidization, oxygen in the copper liquid will reach 0.8-1.5%, which demands large amounts of reduction gas to carry out deep reduction and reduce oxygen to less than 0.2%.

Core content of the invention: First, inert gas is continuously put in during the whole anode feeding course, to make sulfur in the coarse copper liquid react in priority with oxygen in the liquid or with that absorbed from atmosphere: $Cu_2S+2Cu_2O=6Cu+SO_2Cu_2S+O_2=2Cu+SO_2$, so as to eliminate sulfur; Second, conduct low-oxidization and low-reduction operation, i.e. to carry out reduction while the sulfur is reduced to 0.05% through low-oxidization, but not to start deep reduction till the sulfur is reduced to less than 0.003% through deep-oxidization in traditional technique. The process of inletting inert gas during the course of anode furnace feeding, which can make the sulfur in coarse copper liquid react fully with oxygen in the liquid or oxygen absorbed from atmosphere, is the key to reduce refining time drastically.

Coarse copper liquid produced from flash converting is led to the anode furnace in a rate of 50-100 tons per hour. To an anode furnace with capacity of 500 tones, the course will last for five to ten hours, and during which, sulfur can be eliminated in the form of $SO_2$ through reaction between the sulfur and oxygen in the liquid and that absorbed from atmosphere as long as inert gas is continuously inlet through ventilation installation at the bottom of the anode furnace and make coarse copper liquid stirring and boiling.

After anode furnace feeding, carry out low (no) oxidization and low (no) reduction according to the sulfur content in the anode furnace.

While sulfur content of the copper liquid is more than 0.05%, low oxidization and low reduction is adopted, i.e. blow air through air-inlet of the anode furnace to carry out low oxidization till the sulfur content is reduced to 0.05%, and then let in reduction gas through air-inlet of the anode furnace to carry out low reduction.

While sulfur content of the copper liquid is less than or equal to 0.05%, non-oxidization and low-reduction is adopted, i.e. let in natural gas or other reduction gas directly from air-inlet of the anode furnace to carry out low-reduction on the liquid, with major reactions as follows: $4Cu_2O+$ $CH_4$=8Cu+$CO_2$+2$H_2O$ $Cu_2S$+2$Cu_2O$=6Cu+$SO_2$, till final sulfur content ≦0.003%, and oxygen content ≦0.2%.

While sulfur content of the copper liquid ≦0.003% and oxygen content ≦0.2%, oxidization and reduction process can be cancelled, with anode plate casting directly performed.

The inert gases are argon, nitrogen and other gases that will not participate in the process chemical reaction.

The reduction gases are natural gas, liquefied petroleum, city gas, and so on.

The invention is applicable to the refinement of high-sulfur content coarse copper, with sulfur content 0.1%-5%, produced from all kinds metallurgic furnace.

Technological parameters: high-sulfur coarse copper liquid flows to the anode furnace in a rate of 50-100 tons per hour; inert gas flow rate 50~2000 $Nm^3/h$ (determined by the capacity of the furnace), pressure 0.4~0.8 MPa, temperature 25° C.~300° C.; reduction gas flow rate 100~1000 $Nm^3/h$ (determined by the capacity of the furnace), pressure 0.3~0.8 MPa, inside-furnace pressure ±200 Pa; low oxidization air flow rate 100~1000 $Nm^3/h$ (determined by the capacity of the furnace), pressure 0.3~0.8 MPa; ventilation facilities 1~10 units (determined by the capacity of the furnace), refining time 2 hours.

As mentioned above, the advantages of the invention are that it can cancel deep-oxidization and deep-reduction process in the anode furnace, reduce working time from 10 hours to less than 2 hours, notably improve production efficiency and capacity of the anode furnace, save energy, reduce consumption of natural gas and other reducers by more than 70%, and resolve the pollution problem of black smoke. Moreover, the anode plates produced in the method above will meet requirements for electrolysis, i.e. the content of Cu≧99.3%, S≦0.003% and O≦0.2%.

Figure 1:
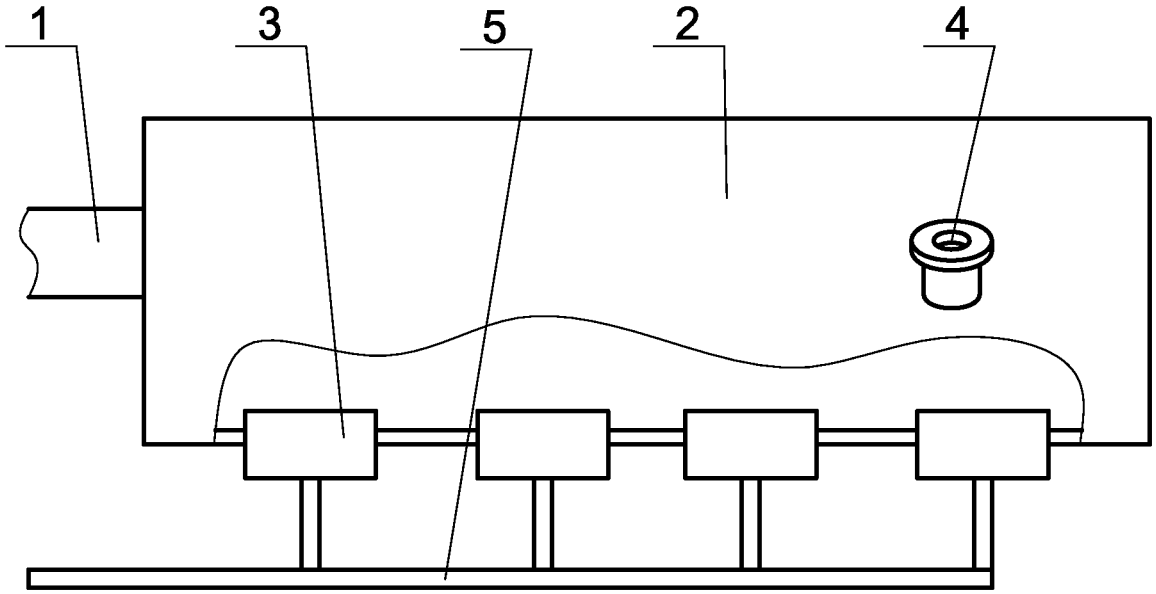
FIG. 1 is the structural diagram of anode furnace in the invention, in which the anode furnace is connected with chute and air pipes.

Tabs in the figure: 1 chute 2 anode furnace 3 ventilation installation 4 air inlet 5 air pipes

DETAIL DESCRIPTION OF THE INVENTION

Reference FIG. 1 specifically indicates the technological process: pour coarse copper produced in flash converting furnace to anode furnace 2 through the chute 1 in a rate of 50~100 tons per hour, and during the course, continuously blow inert gas into the furnace through the ventilation facilities 3 at the bottom of the anode furnace 2 in a rate of 50~2000 $Nm^3/h$ (determined by the capacity of the furnace), pressure 0.4~0.8 MPa and temperature 25° C.~300° C. Inert gas keeps the coarse copper liquid boiling and improves reaction between the sulfur and oxygen in the liquid and that absorbed through liquid surface; produced $SO_2$ is discharged from the liquid to reach the goal of sulfur elimination. After the feeding course, low (no) oxidization and low (no) reduction is adopted according to the sulfur content of copper liquid in anode furnace 2.

While sulfur content of copper liquid >0.05%, low oxidization and low reduction is conducted, i.e. air is led in through air inlet 4 on the lateral wall of anode furnace 2 to perform low-oxidization, with air flow rate 100~1000 $Nm^3/h$ (determined by the capacity of the anode furnace), pressure 0.3~0.8 MPa, till sulfur content in the liquid is less than 0.05%. Then, low reduction is conducted by inlet of natural gas to anode furnace 2 through air inlet 4, with flow rate of natural gas 100~1000 $Nm^3/h$, pressure 0.3~0.8 MPa, till sulfur content of the copper liquid ≦0.003% and oxygen content ≦0.2%.

While sulfur content of copper liquid ≦0.05%, non-oxidization and low-reduction is conducted, i.e. natural gas is directly led in through air inlet 4 on the lateral wall of anode furnace 2 to perform low-reduction, with flow rate of natural gas 100~1000 $Nm^3/h$, pressure 0.3~0.8 MPa, till sulfur content of the copper liquid ≦0.003% and oxygen content ≦0.2%.

While sulfur content of copper liquid ≦0.003% and oxygen content ≦0.2%, oxidization and reduction process can be cancelled, with anode plate casting directly conducted.

To further improve the stirring effect of inert gas on copper liquid and raise production efficiency, inert gas can be led into anode furnace 2 through ventilation installation 3 and air inlet 4 jointly in practice.

The technological scheme of the invention is not limited to the scope of the practical examples stated. All the technical content that not described here for detail is public-known.

What is claimed is:

1. An anode refinement method for high-sulfur content coarse copper comprising the following steps:

while high-sulfur coarse copper liquid from a flash converting furnace flowing to an anode furnace through a chute inert gas is continuously added into the anode furnace to stir the copper liquid and to improve discharging of $SO_2$ produced from reactions of the sulfur with oxygen in the liquid and the atmosphere, so as to remove more than 90% of the sulfur in the coarse copper liquid;

after the coarse copper liquid is fully led to the anode furnace, an operation of low-oxidization low-reduction or non-oxidization low-reduction is conducted or not according to the sulfur content of the copper liquid.

2. The anode refinement method for high-sulfur content coarse copper of claim 1, wherein after the coarse copper is fully led to the anode furnace, the operation of low-oxidization low-reduction operation is adopted if the sulfur content of the copper liquid is more than 0.05%, i.e., to conduct low-reduction after the sulfur is reduced to 0.05% by the low-oxidization; if the sulfur content is less than 0.05%, the operation of non-oxidization low-reduction is adopted; if the sulfur content is less than 0.003% and oxygen content less than 0.2%, either operation of the low-oxidization low-reduction or non-oxidization low reduction is cancelled.

3. The anode refinement method for high-sulfur content coarse copper of claim 1, wherein the coarse copper liquid flows to the anode furnace with flow rate of 50-100 tons per hour;

flow rate of inert gas 50~2000$Nm^3/h$, pressure 0.4~0.8MPa, temperature 25~300° C.; air flow rate for low-oxidization 100~1000$Nm^3/h$, pressure 0.3~0.8MPa; gas flow rate for low-reduction 100~1000$Nm^3/h$, pressure 0.3~0.8MPa; inside-furnace pressure ±200Pa.

4. The anode refinement method for high-sulfur content coarse copper of claim 2, wherein the coarse copper liquid flows to the anod furnace with flow rate of 50-100 tons per hour;

flow rate of inert gas 50~2000$Nm^3/h$, pressure 0.4~0.8MPa, temperature 25~300° C.; air flow rate for low-oxidization 100~1000$Nm^3/h$, pressure 0.3~0.8MPa; gas flow rate for low-reduction 100~1000$Nm^3/h$, pressure 0.3~0.8MPa; inside-furnace pressure ±200Pa.

5. The anode refinement method for high-sulfur content coarse copper of claim 1, wherein the inert gas is argon or nitrogen.

6. The anode refinement method for high-sulfur content coarse copper of claim 2, wherein the inert gas is argon or nitrogen.

7. The anode refinement method for high-sulfur content coarse copper of claim 1, wherein the reduction gas is natural gas, liquefied petroleum gas or city gas.

8. The anode refinement method for high-sulfur content coarse copper of claim 2, wherein the reduction gas is natural gas, liquefied petroleum gas or city gas.

9. The anode refinement method for high-sulfur content coarse copper of claim 1, wherein the inert gas is blown to the anode furnace through ventilation installation in the form of bricks at the bottom of the furnace.

10. The anode refinement method for high-sulfur content coarse copper of claim 2, wherein the inert gas is blown to the anode furnace through ventilation installation in the form of bricks at the bottom of the furnace.

11. The anode refinement method for high-sulfur content coarse copper of claim 1, wherein it is applicable for refinement of high-sulfur content coarse copper, with sulfur content of 0.1%~5%, from all kinds of metallurgic furnaces.

* * * * *